US006568757B2

(12) United States Patent
Lin et al.

(10) Patent No.: US 6,568,757 B2
(45) Date of Patent: May 27, 2003

(54) CONTROL DEVICE FOR SEAT POST OF OFFICE CHAIRS

(76) Inventors: Ming Chuan Lin, 11F-2, No. 43, Chai-I Street, Taichung City (TW); Jack Wang, 4F, No. 357, Da-Na Road, Su-Lin, Taipei City (TW)

( * ) Notice: Subject to any disclaimer, the term of this patent is extended or adjusted under 35 U.S.C. 154(b) by 0 days.

(21) Appl. No.: 09/875,858

(22) Filed: Jun. 8, 2001

(65) Prior Publication Data

US 2002/0185900 A1 Dec. 12, 2002

(51) Int. Cl.[7] ..... A47C 3/24

(52) U.S. Cl. ..... 297/344.1; 297/344.12; 297/344.18; 297/344.21; 248/405; 248/161; 403/371; 403/109.5

(58) Field of Search ..... 297/344.12, 344.18, 297/344.21, 314; 248/405, 131, 132, 161, 157; 403/371, 109.5

(56) References Cited

U.S. PATENT DOCUMENTS 3,870,270 A * 3/1975 Holtz ..... 297/344.12
4,720,071 A * 1/1988 Nelson et al. ..... 297/344.21
4,757,778 A * 7/1988 Scaglia ..... 403/109.5 X
4,828,212 A * 5/1989 Dicks ..... 297/344.12
5,044,299 A * 9/1991 Frank ..... 297/344.18
5,116,004 A * 5/1992 Luecke ..... 248/161
5,722,627 A * 3/1998 Hoshino ..... 297/344.18 X
5,816,556 A * 10/1998 Liao ..... 297/344.18 X
5,842,742 A * 12/1998 Hoshino ..... 297/344.18 X
5,927,810 A * 7/1999 Liao ..... 297/344.12
6,361,243 B1 * 3/2002 Geib ..... 403/371 X
6,467,989 B1 * 10/2002 Finkelstein ..... 403/371

* cited by examiner

*Primary Examiner*—Peter M. Cuomo
*Assistant Examiner*—Rodney B. White
(74) *Attorney, Agent, or Firm*—Charles E. Baxley

(57) ABSTRACT

An office chair includes a frame having a tube with a tapered inner periphery and a plurality of legs extend from the tube. A C-shaped sleeve is movably received in the tube and has a tapered outer periphery. The sleeve has a threaded inner periphery so as to be threadedly engaged with a seat post. Two notches are defined in the tapered outer periphery of the sleeve so that two pins extend through the tube and are engaged with the two notches to restrict the sleeve from being rotated. The sleeve is firmly clamp the seat post when a load is applied downward the seat post. When lifting the seat post, the sleeve is raised and loosened so that the seat post is adjustable.

2 Claims, 3 Drawing Sheets

CONTROL DEVICE FOR SEAT POST OF OFFICE CHAIRS

FIELD OF THE INVENTION

The present invention relates to a control device for holding the seat post of office chairs and the seat post is enclosed by a C-shaped sleeve with tapered inner periphery and the sleeve is received in a tapered hole of the base frame.

BACKGROUND OF THE INVENTION

A conventional office chair includes a control device that controls the height of the seat and generally involves a hydraulic cylinder and the seat post is connected to the piston rod of the cylinder so that when the users operate the hydraulic cylinder, the seat post is lowered or raised by the movement of the piston rod. However, the cylinder is expensive and has a potential problem of leakage of the liquid in the cylinder. Besides, the number of parts composing the cylinder is large and every part has to be machined to have suitable holes. All of these make the office chair to have a high price and cannot be popular for most of the customers. In other words, there are no office chairs, in the market having adjustable height of the seat and sold at lower price.

The present invention intends to provide an office chair that has a control device for holding the seat post and the seat post is easily to be lowered or lifted.

SUMMARY OF THE INVENTION

In accordance with one aspect of the present invention, there is provided an office chair and comprises a frame having a tube with a tapered inner periphery and two holes are defined through the tube. A plurality of legs extend from the tube. A C-shaped sleeve is movably received in the tube and has a tapered outer periphery. The sleeve has a threaded inner periphery and a slit is defined longitudinally through the sleeve. Two notches are defined in the tapered outer periphery of the sleeve and two pins extend through the two holes in the tube and are engaged with the two notches. A seat post extends through the sleeve and has a threaded section which is engaged with the threaded inner periphery.

The primary object of the present invention is to provide an office chair wherein the seat post is firmly positioned when a load is applied on the seat post, and the seat post can be adjustable when lifting the seat post.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
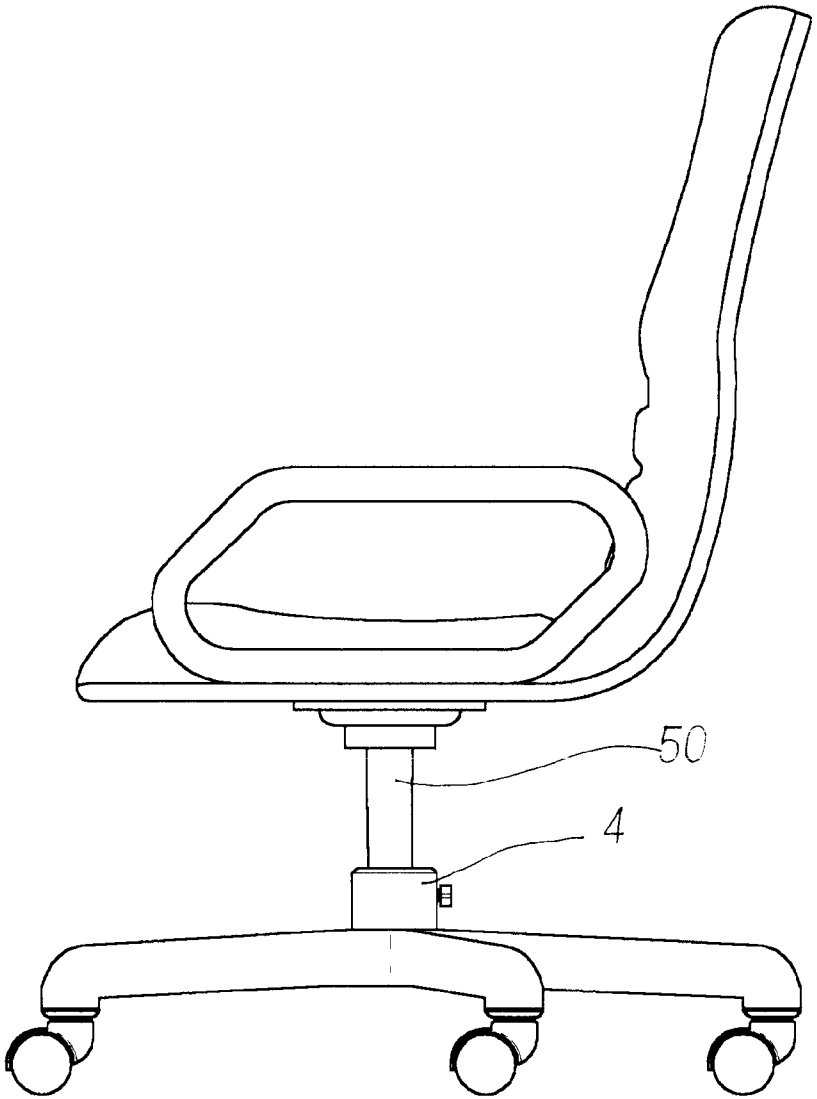
FIG. 1 is a plan view to show an office chair of the present invention.
Figure 2:
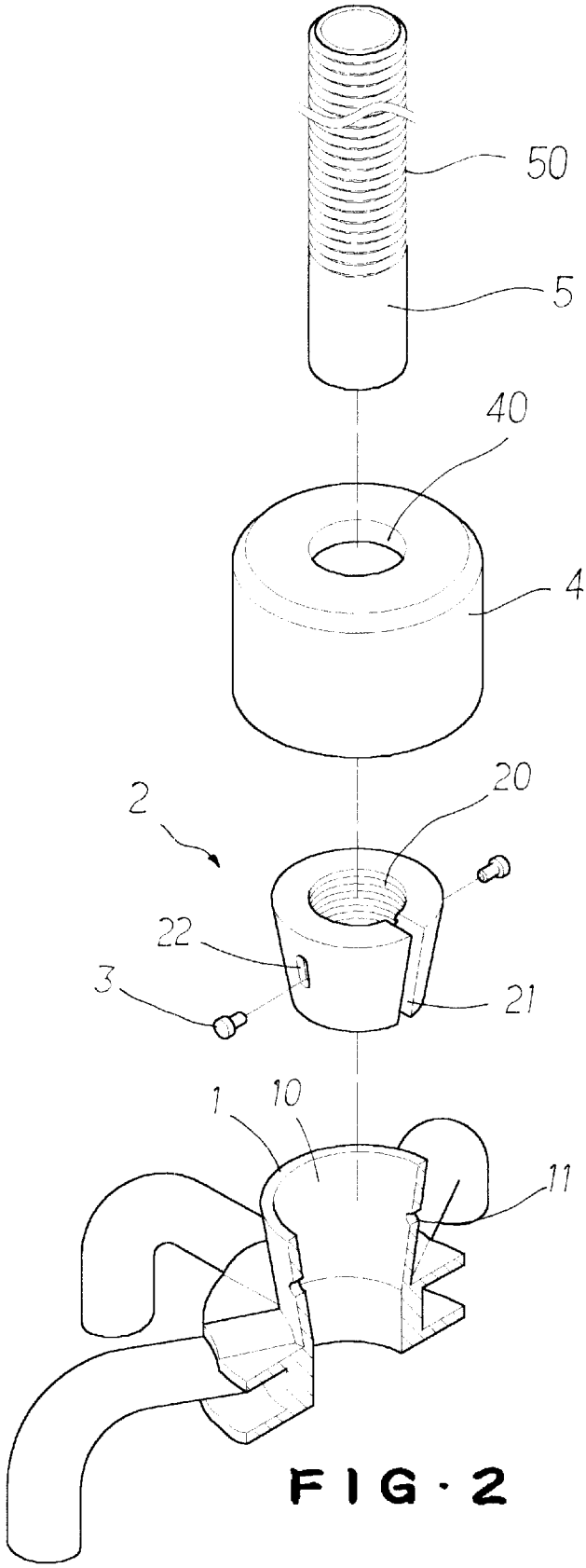
FIG. 2 is an exploded view to show the control device for clamping the seat post of the chair of the present invention.
Figure 3:
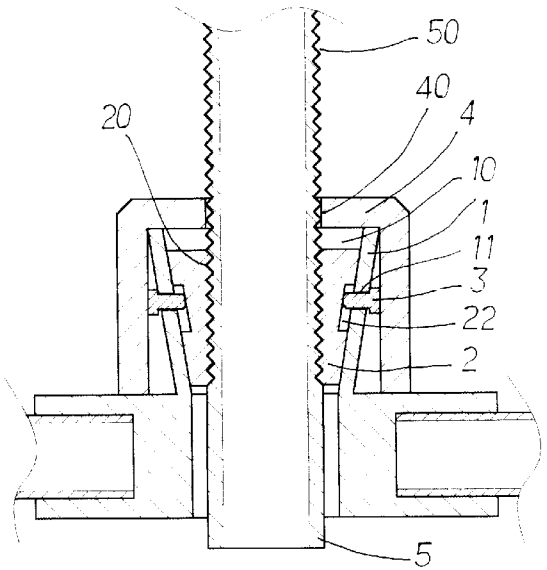
FIG. 3 is a cross sectional view to show that the seat post is clamped by the sleeve.

Referring to FIGS. 1 to 3, the office chair of the present invention comprises a frame having a tube 1 with a tapered inner periphery 10 and a plurality of legs extend from the tube 1. Two holes 11 are defined through the tube 1. A C-shaped sleeve 2 is movably received in the tube 1 and has a tapered outer periphery which is complementary to the tapered inner periphery 10 of the tube 1. The sleeve 2 has a threaded inner periphery 20 and a slit 21 is defined longitudinally through the sleeve 2. Two notches 22 are defined in the tapered outer periphery of the sleeve 2 so that two pins 3 extend through the two holes 11 in the tube 1 and are engaged with the two notches 22 to prevent the sleeve 2 from rotating in the tube 1.

Figure 4:
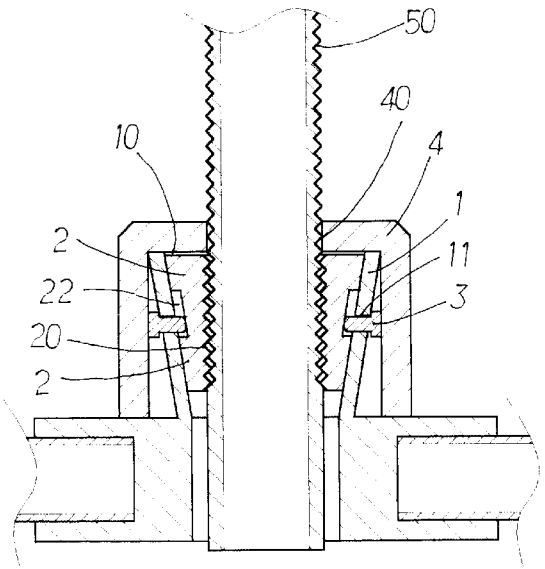
FIG. 4 is a cross sectional view to show that the seat post is lifted and the sleeve is loosened for the seat post.
Figure 5:
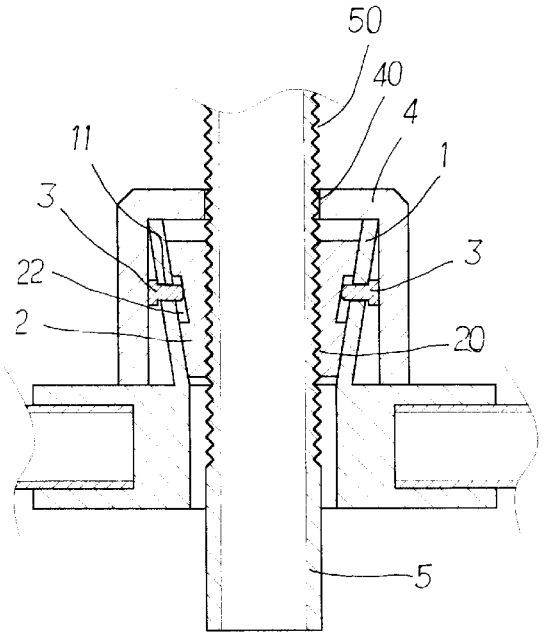
FIG. 5 is a cross sectional view to show that the seat post is clamped again by the sleeve.

A cap 4 is mounted to the tube 1 and the two pins 3 are covered by the cap 4. A seat post 5 extends through the sleeve 2 and has a threaded section 50 which extends through a hole 40 in the cap 4 and is engaged with the threaded inner periphery 20. When a load is applied on the seat post 5, the sleeve 2 is pushed downward and the slit 21 is narrowed because the engagement between the tapered outer periphery of the sleeve 2 and the tapered inner periphery 10 of the tube 1. This makes the sleeve 2 to firmly clamp the seat post 5. As shown in FIG. 4, when the seat post 5 is lifted, the sleeve 2 is moved upward together with the seat post 5 and the slit 21 is widened so that the seat post 5 can be adjusted by rotating the seat post 5. When the seat post 5 is adjusted to a desired height, the load is applied to the seat post again to let the sleeve 2 securely engaged with the tapered inner periphery 10 of the tube 1.

The control device has a simple but efficient structure and the height of the seat post 5 is easily to be adjusted.

While we have shown and described the embodiment in accordance with the present invention, it should be clear to those skilled in the art that further embodiments may be made without departing from the scope of the present invention.

What is claimed is:

1. An office chair comprising:

a frame having a tube with a tapered inner periphery and two holes defined through said tube, a plurality of legs extending from said tube;

a C-shaped sleeve having a tapered outer periphery which is complementary to said tapered inner periphery of said tube, said C-shaped sleeve being received in said tube, said tapered outer periphery of said C-shaped sleeve being engaged with said tapered inner periphery of said tube, two notches defined in said tapered outer periphery of said sleeve, two pins extending through said two holes in said tube and engaged with said two notches, said sleeve having a threaded inner periphery and a slit defined longitudinally thought said sleeve, and a seat post extending through said sleeve and having a threaded section which is engaged with said threaded inner periphery such that when said seat post is pushed toward said tube, said C-shaped sleeve sinks in said tapered inner periphery axially of said tube with said slit being narrowed, and said C-shaped sleeve moves with said seat post with said slit being widened when said seat post is lifted in a direction away from said tube.

2. The office chair as claimed in claim 1 further comprising a cap mounted to said tube and said two pins being covered by said cap.

* * * * *